US007942293B2

(12) United States Patent
Lawrence et al.

(10) Patent No.: US 7,942,293 B2
(45) Date of Patent: May 17, 2011

(54) COSMETIC HOLDER FOR CARRYING BY USER

(76) Inventors: Steven Lawrence, Millwood, NY (US); Scott Hersh, Tarrytown, NY (US); Joseph L. Molino, Valley Cottage, NY (US)

( * ) Notice: Subject to any disclaimer, the term of this patent is extended or adjusted under 35 U.S.C. 154(b) by 894 days.

(21) Appl. No.: 11/893,670

(22) Filed: Aug. 17, 2007

(65) Prior Publication Data

US 2009/0044825 A1 Feb. 19, 2009

(51) Int. Cl.
*A45F 3/14* (2006.01)

(52) U.S. Cl. ..... 224/218; 224/197; 224/219; 224/221; 224/272; 269/249; 269/143; 269/246; 269/6; 29/257; 29/276

(58) Field of Classification Search ..... 224/218, 224/217, 219, 571, 582, 197, 272; 294/25; 30/298; 132/29.4; 248/288.31, 288.51, 229.12, 248/230.8; 269/249, 143, 246, 6; 29/257, 29/276; 623/65

See application file for complete search history.

(56) References Cited

U.S. PATENT DOCUMENTS

| | | | | | |
|---|---|---|---|---|---|
| 1,181,527 | A * | 5/1916 | Hooper | 30/298 |
| 1,609,481 | A * | 12/1926 | McCarthy et al. | 224/219 |
| 1,766,478 | A * | 6/1930 | Baker et al. | 224/218 |
| 3,273,766 | A * | 9/1966 | Cosentino | 224/197 |
| 3,489,383 | A * | 1/1970 | Anson | 248/231.71 |
| 4,165,896 | A * | 8/1979 | Hunt | 294/25 |
| 5,005,697 | A * | 4/1991 | Jimbo et al. | 206/235 |
| 5,007,612 | A * | 4/1991 | Manfre | 248/558 |
| 5,240,214 | A * | 8/1993 | Birnbaum et al. | 248/231.41 |
| 5,597,189 | A * | 1/1997 | Barbee, Sr. | 294/25 |
| 6,315,426 | B1 * | 11/2001 | Buller, Jr. | 362/108 |
| 6,360,928 | B1 * | 3/2002 | Russo | 224/218 |
| 6,493,982 | B1 * | 12/2002 | Macaluso | 43/25 |
| 6,601,813 | B1 * | 8/2003 | Kager et al. | 248/314 |

* cited by examiner

*Primary Examiner* — Nathan J Newhouse
*Assistant Examiner* — Steven M Landolfi, Jr.
(74) *Attorney, Agent, or Firm* — Lawrence G. Fridman

(57) ABSTRACT

A cosmetic holder includes a mounting base adapted for mounting to an appendage of a user, a plurality of cosmetic containers for storing cosmetics and/or cosmetic accessories, and a swivel joint connected between the mounting base and a selected cosmetic container for adjusting a position of the cosmetic container with respect to the mounting base about three mutually perpendicular axes.

14 Claims, 8 Drawing Sheets

FIG. 11
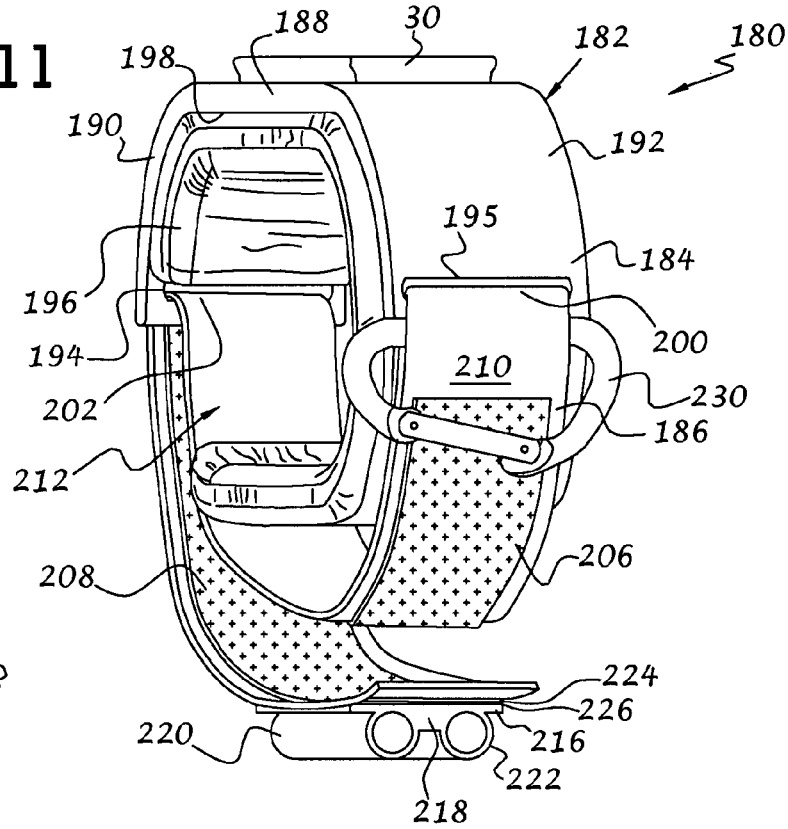
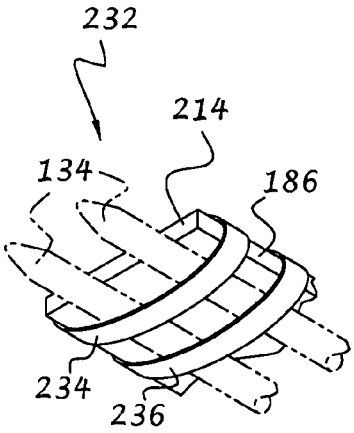
FIG. 13
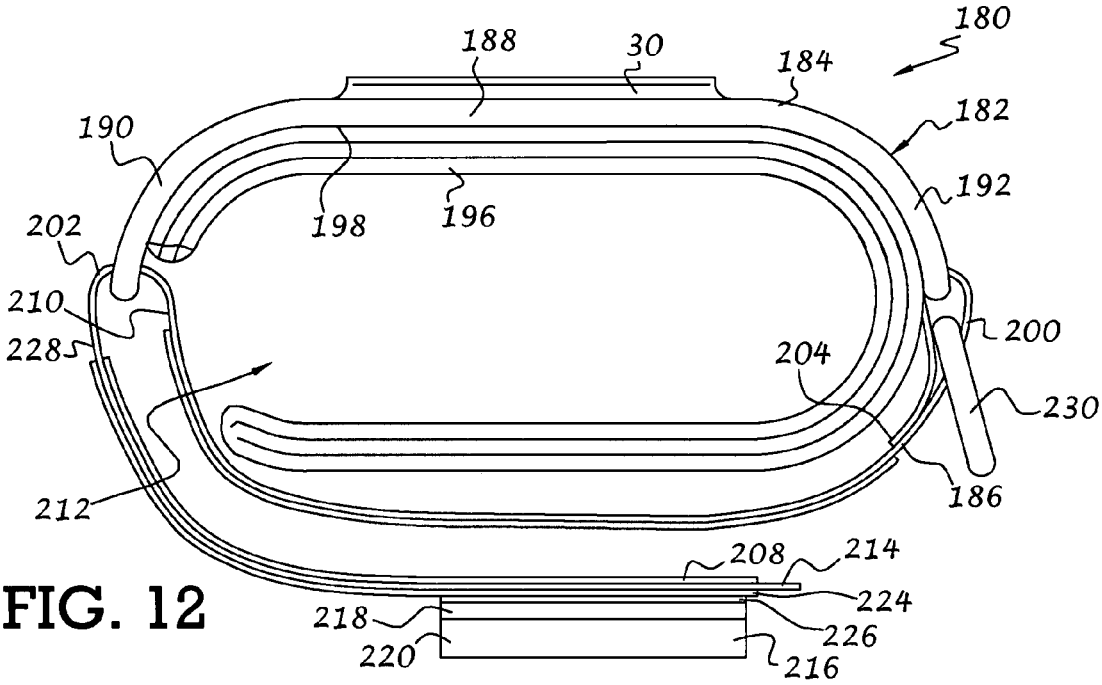
FIG. 12

COSMETIC HOLDER FOR CARRYING BY USER

BACKGROUND OF THE INVENTION

The present invention relates generally to makeup artistry, and more particularly to a holder for cosmetics and accessories that can be mounted to an appendage of a makeup artist or other user to facilitate application of the cosmetics to others.

Cosmetics, such as foundations, blushes, eye shadows, lipsticks, and so on, are often used in various broadcast, theatrical, movie and medical industries for enhancing or diminishing a person's features as well as creating special effects such as scars, blemishes, special character attributes, and so on. These cosmetics come in a myriad of styles, materials, colors and consistencies, such as oil-, water-, alcohol- and mineral-based pastes, creams, powders, gels, and sticks and are typically applied with brushes, pencils, pads, and so on. Such cosmetics are often mixed in various combinations to create other materials, colors and/or consistencies depending on such factors as a person's natural skin tone, features and preferences, background and foreground colors and lighting, clothing or costume colors, as well as the mood or ambiance requirements associate with a particular set or scene.

Since many situations require the makeup artist to go from one actor or actress to another on an expedited basis, a large number of cosmetic containers and accessories are carried in a bag or other carrier. However, rummaging through a bag to locate a particular cosmetic case, color and/or accessory can be both time consuming and stressful. In addition, when the particular cosmetic case is found, it is typically held in one hand of the makeup artist while the other hand is free for applying the makeup, thus reducing the efficiency of the makeup artist even more. In some situations where a scar, cut or other special effects must be applied to a person lying on the ground for a particular scene, the makeup artist's balance may be compromised while holding one or more cosmetic cases with one hand and applicators or other accessories with the other hand.

Accordingly, it would be desirous to facilitate the carrying and selection of cosmetics and accessories while freeing both hands for applying the cosmetics to a person in any required position. It would also be desirous to provide a plurality of cosmetic cases that can be simultaneously held or carried by a user without limiting the usefulness of one or both hands.

BRIEF SUMMARY OF THE INVENTION

According to one aspect of the invention a cosmetic holder comprises a mounting base adapted for mounting to an appendage of a user; a first cosmetic container for storing at least one of a cosmetic and a cosmetic accessory; and a swivel joint connected between the mounting base and the cosmetic container for adjusting a position of the cosmetic container with respect to the mounting base.

According to a further aspect of the invention, a cosmetic kit comprises a mounting base adapted for mounting to an appendage of a user; and a plurality of cosmetic containers interchangeably connectable to the mounting base. Each cosmetic container has a different combination of cosmetics and/or cosmetic accessories.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein:

FIG. 11 is a perspective view of a mounting base in accordance with still a further embodiment of the invention;

FIG. 12 is a side elevational view of the mounting base of FIG. 11; and

FIG. 13 is a bottom perspective view of an accessory holder in accordance with a further embodiment of the invention.

It is noted that the drawings are intended to depict only typical embodiments of the invention and therefore should not be considered as limiting the scope thereof. In addition, the drawings may not necessarily be to scale. The invention will now be described in greater detail with reference to the accompanying drawings.

DETAILED DESCRIPTION OF THE INVENTION

Figure 1:
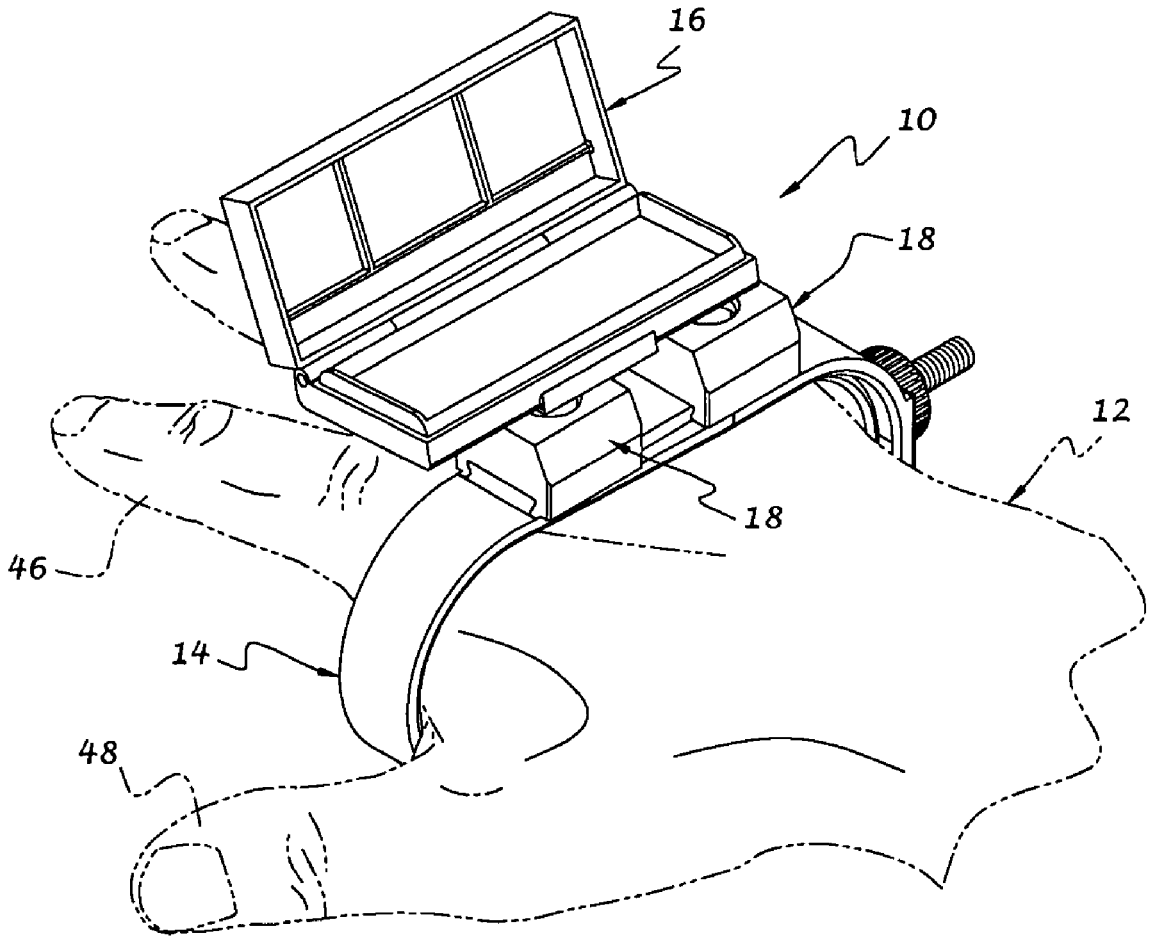
FIG. 1 is a top perspective view of a cosmetic holder mounted to the hand of a user.
Figure 2:
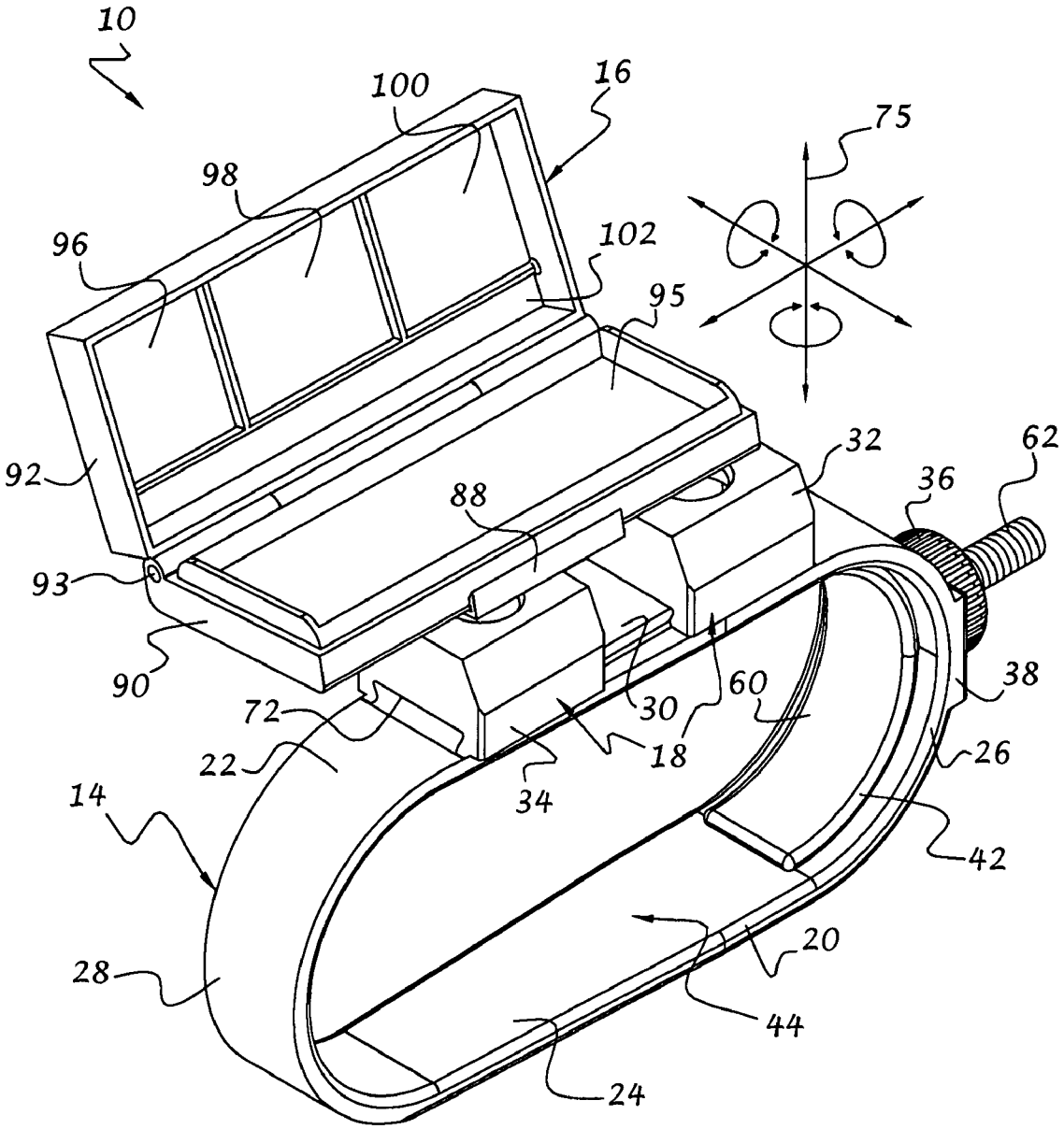
FIG. 2 is an enlarged top perspective view of the cosmetic holder.

Referring to the drawings, and to FIGS. 1 and 2 in particular, a cosmetic holder 10 in accordance with an exemplary embodiment of the present invention is illustrated. The cosmetic holder 10 is preferably adapted for mounting to an appendage of a user, such as a hand 12. To that end, the cosmetic holder 10 preferably includes a mounting base 14 and at least one cosmetic container 16 adjustably connected to the mounting base through a swivel joint 18. The swivel joint 18 permits the user to adjust a position of the cosmetic container 16 with respect to the mounting base 14 so that the contents of the container are easily accessible by the user, whether the cosmetic holder is mounted on the left or right hand. It will be understood that the term "cosmetic" as used throughout the specification refers not only to different colored pastes, powders, gels, creams, sticks and so on, but also to cosmetic accessories such as brushes, pencils, pads, mirrors, and so on.

With additional reference to FIGS. 3-7, the mounting base 14 preferably includes a continuous band 20 with an upper wall 22, a lower wall 24, and curved side walls 26, 28 extending between the upper and lower walls. In this embodiment, the band 20 is preferably constructed of a rigid or semi-rigid material. A dovetail-shaped projection 30 extends along the length of the upper wall 22 for receiving one or more mounting blocks 32, 34. An opening 40 is formed in a raised portion 38 of the side wall 26 for receiving an adjustment knob 36, which in turn receives an adjustable clamping member 42 so that the space 44 within the band 20 can be adjusted for accommodating different hand sizes of different users. Preferably, the band 20 narrows from the side wall 26 to the side wall 28 so that the band can be comfortably received between the thumb 46 and index finger 48 of the hand 12, as shown in FIG. 1.

Figure 3:
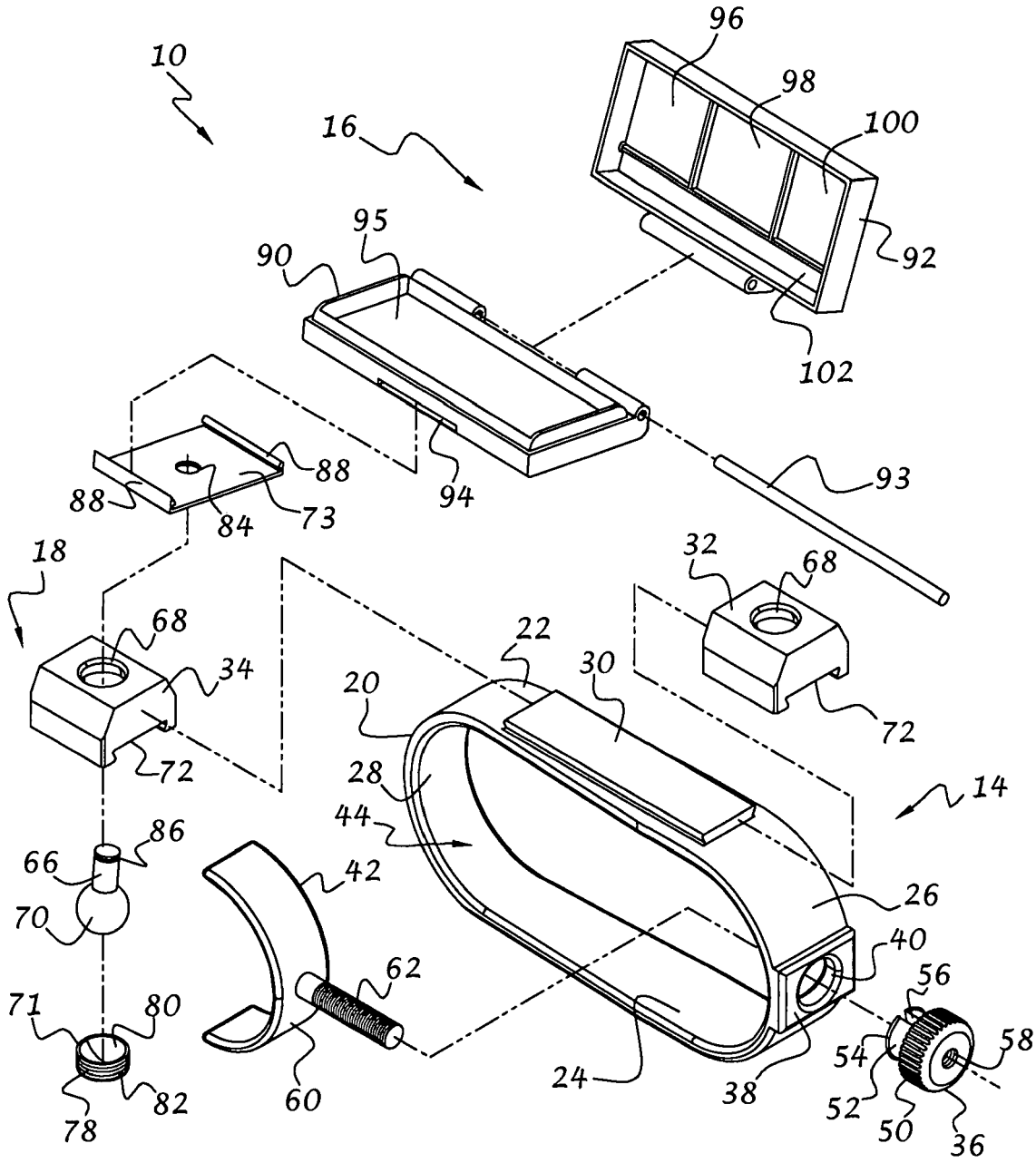
FIG. 3 is an exploded perspective view of the cosmetic holder.
Figure 7:
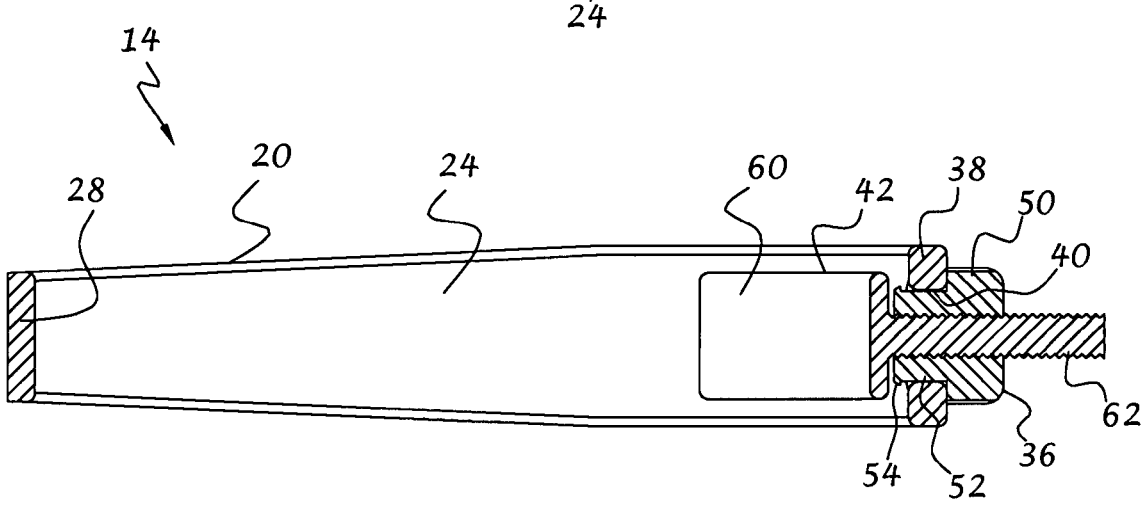
FIG. 7 is a sectional view of the cosmetic holder taken along line 7-7 of FIG. 4.

As best shown in FIGS. 3 and 7, the adjustment knob 36 preferably has a gripping portion 50, a bearing portion 52 that extends from the gripping portion, and an annular flange 54 that extends radially outwardly from a distal end of the bearing portion 52. A slot 56 is formed in the bearing portion 52 and annular flange 54 while a threaded bore 58 extends through the gripping portion 50 and the bearing portion 52. The slot 56 facilitates installation of the bearing portion 52 within the opening 40 of the band 20, while the annular flange 54 and gripping portion 50 located on opposite sides of the opening 40 ensure that the knob 36 is rotatably connected to the side wall 26.

Figure 4:
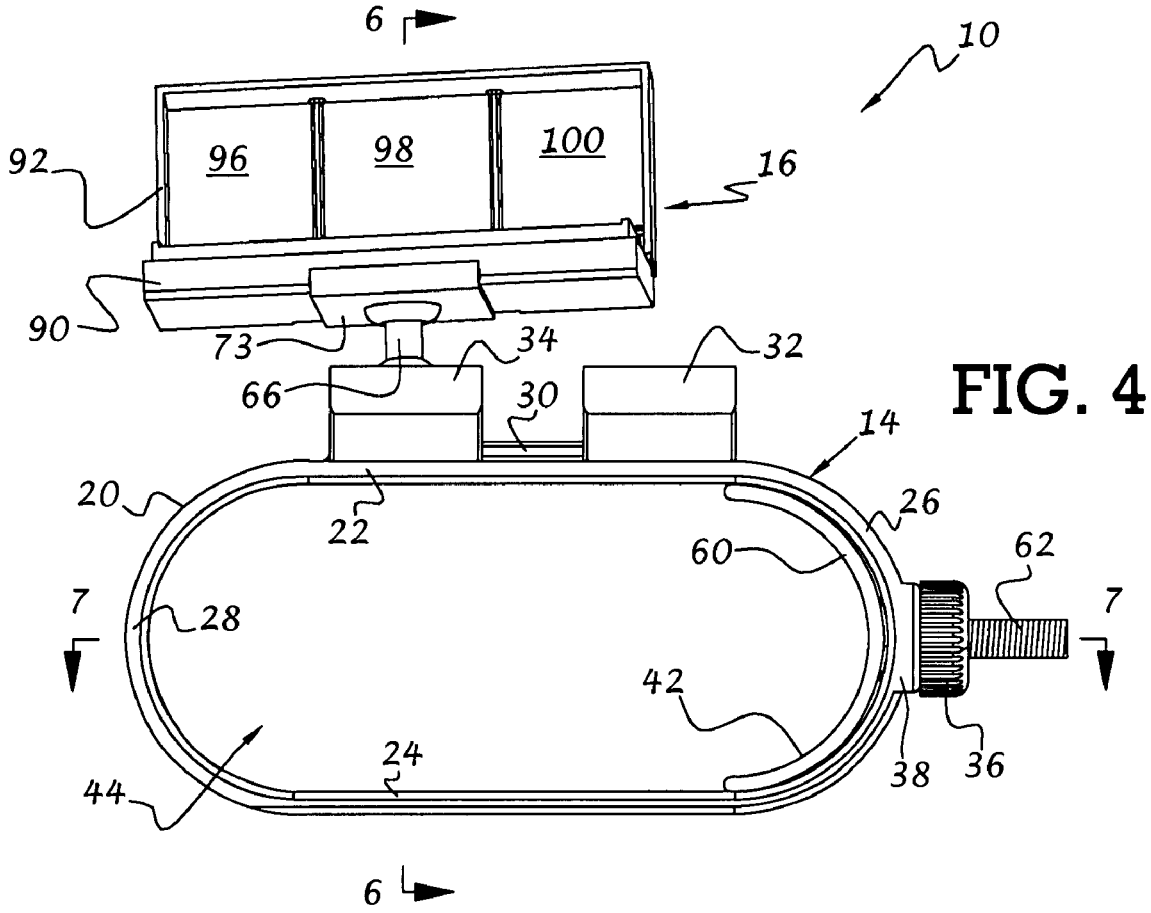
FIG. 4 is a front elevational view of the cosmetic holder.
Figure 5:
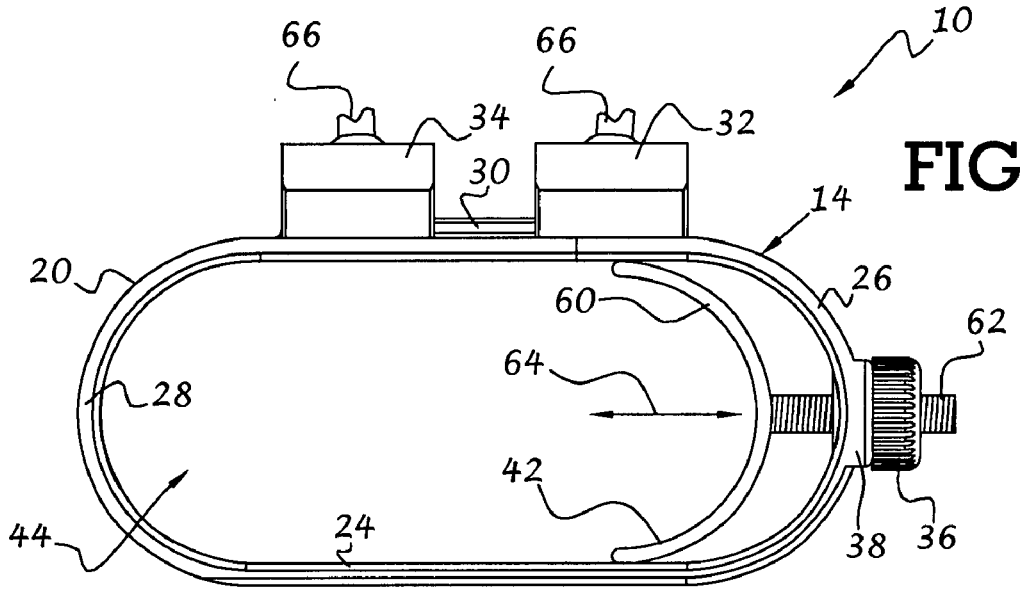
FIG. 5 is a front elevational view of a portion of the cosmetic holder showing adjustment of a clamping portion.

The clamping member 42 preferably has a yoke portion 60 that is similar in shape to the side wall 26 and a threaded shaft portion 62 that extends from a center of the yoke portion 60 and engages the threaded bore 58 of the adjustment knob 36. In use, as the adjustment knob 36 is rotated in the clockwise or counter-clockwise direction, the yoke portion 60 is moved toward or away from the side wall 28, as represented by arrow 64 in FIG. 5. In this manner, the width of the space 44 between the side wall 28 and the yoke portion 60 can be adjusted to accommodate different hand sizes of different users. Although not shown, padding material, such as memory foam, can be attached to one or more inner surfaces of the band 20 and/or yoke portion 60 that face the hand 12 for providing a more comfortable and secure fit for the user. It is illustrated in FIGS. 3, 4 and 5 that the yoke portion 60 is symmetrical about the threaded shaft portion 62. The yoke portion 60 engages and is guided by inner surfaces of the elongated upper wall 22 and lower wall 24.

Figure 6:
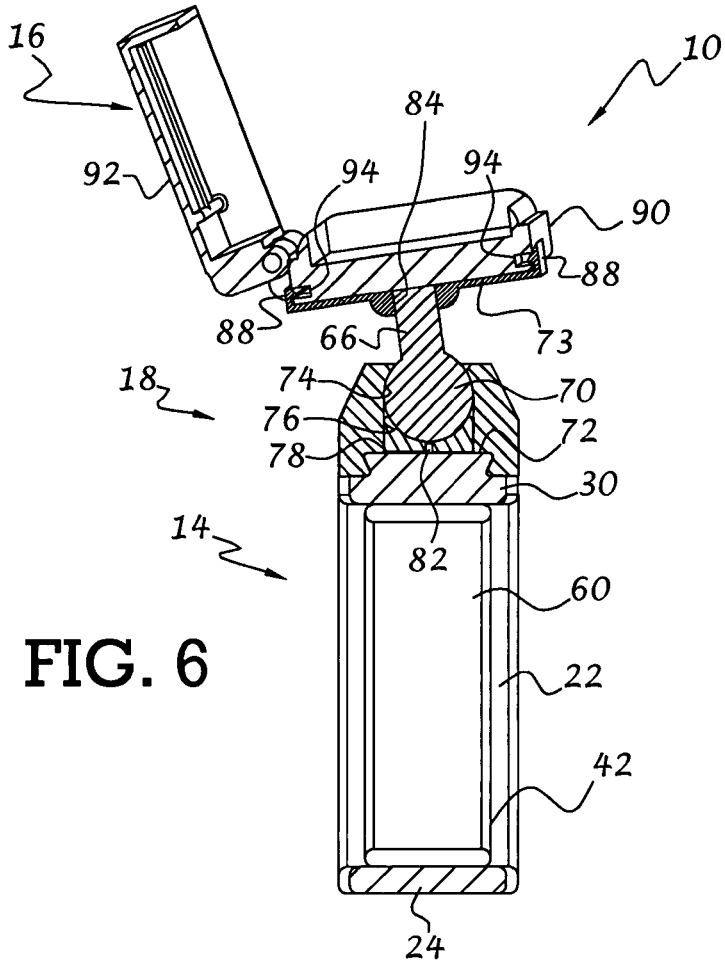
FIG. 6 is a sectional view of the cosmetic holder taken along line 6-6 of FIG. 4.

As best shown in FIGS. 3 and 6, the swivel joint 18 preferably includes either the mounting block 32 or 34, a pivot rod 66 extending through a central opening 68 of the mounting block, a ball 70 connected to the pivot rod 66, a lower socket portion 71 connected to the mounting block, and a mounting plate 73 connected to a distal end of the pivot rod 66 for receiving the cosmetic container 16.

The mounting block 32, 34 preferably includes a dovetail-shaped slot 72 for receiving the dovetail-shaped projection 30 of the mounting base 14 and an upper semi-spherically shaped surface 74 that intersects with the central opening 68 and forms an upper socket portion for the ball 70. An inner threaded bore 76 is formed in the mounting base 14 in alignment with the opening 68.

The lower socket portion 71 preferably includes outer threads 78 that engage the threaded bore 76 of the mounting block 32, 34. A lower semi-spherical surface 80 is shaped to receive the ball 70 and a slot 82 is formed in the lower socket portion 72 for engagement with the blade of a screwdriver (not shown) in order to install the lower socket portion in the mounting block.

During assembly, the pivot rod 66 and ball 70 are inserted into the mounting block 32, 34 until the ball seats against the upper surface 74 and the pivot rod extends out of the central opening 68. The lower socket portion 71 is then screwed into the mounting block until the lower surface 80 seats against the ball 70. In this manner, the ball 70 is sandwiched between the upper and lower semi-spherical surfaces 74 and 80, respectively. The compressive force against the ball 70 can be adjusted by tightening or loosening the lower socket portion 71. In this manner, the pivot rod 66, and thus the attached cosmetic container 16, can be pivoted or swiveled about three mutually perpendicular axes, as represented by numeral 75 in FIG. 2, and held in position by the compressive force so that the cosmetic container can be adjusted and held at a desired position for access by a user. Although the swivel joint 18 is shown as rotating about three mutually perpendicular axes, the swivel joint may be modified to rotate about two axes or about a single axis.

The mounting plate 73 preferably has a central threaded opening 84 that engages external threads 86 of the pivot rod 66 for securing the mounting plate and pivot rod together. It will be understood that other means for securing the components together can be used, including but not limited to adhesive bonding, welding, press-fitting, magnetic attraction, hook and loop fasteners, and so on. Alternatively, the mounting plate 73 and pivot rod 66 may be formed as a unitary structure. A pair of elongate clips 88 extend upwardly from the mounting plate 73 for removably receiving the cosmetic container 16.

The cosmetic container 16 preferably includes a tray portion 90 and a cover portion 92 pivotally connected to the tray portion through a hinge pin 93. Elongate grooves 94 are formed in opposite sides of the tray portion 90 for receiving the elongate clips 88 of the mounting plate 73 in a snap-fit engagement to thereby releasably connect the cosmetic container 16 to the mounting base 14. The tray portion 90 and the cover portion 92 can have one or more compartments, as shown for example by compartments 95, 96, 98, 100, and 102, for receiving and/or storing cosmetics and cosmetic accessories as may be required by a user. By way of example, the compartments may include different combinations of makeup colors, pastes, creams, powders, gels, sticks and so on, as well as cosmetic accessories such as brushes, pencils, pads, mirrors, and so on.

The compartments can be integrally formed with the tray and cover portions. In accordance with a further embodiment of the invention, as shown in FIG. 8, removable compartments 105 may be formed separately and installed in the tray and/or cover portions through well known connection means, such as magnetic attraction, hook and loop fasteners, temporary adhesive, clips, and so on.

It will be understood that the cosmetic container 16 may include only the tray portion 90 or cover portion 92 and/or may be of any desired size, shape and/or configuration with any number of compartments. It will be further understood that the cosmetic container 16 can be removably connected to the swivel joint 18 or mounting base 14 through other well known connection means, such as magnets, hook and loop fasteners, double-sided adhesive tape, latches, clamps, removable fasteners, and so on.

Figure 8:
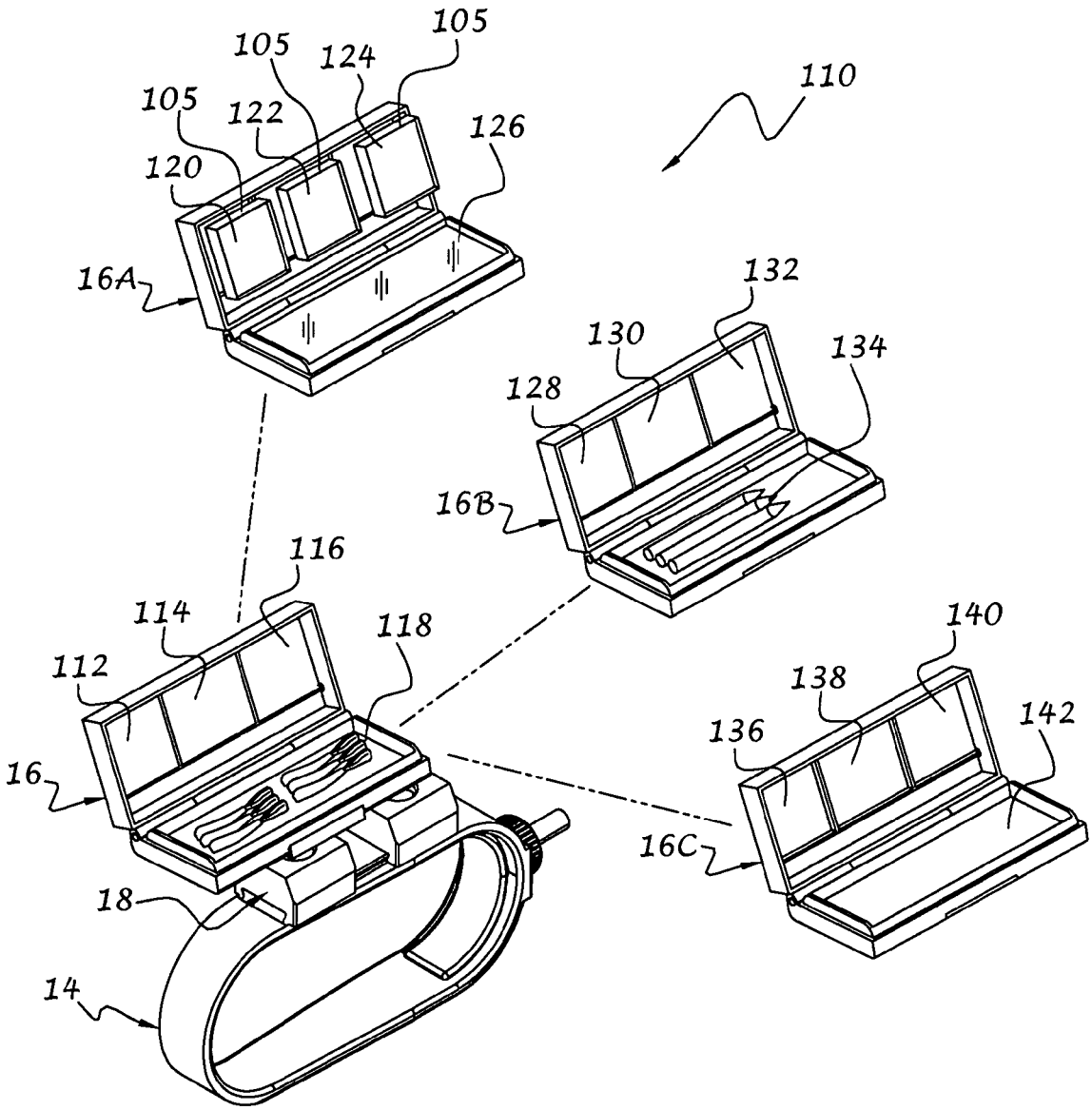
FIG. 8 is a top perspective view of a cosmetic kit including interchangeable cosmetic containers.

Referring now to FIG. 8, a cosmetic kit 110 in accordance with the present invention preferably includes the mounting base 14 for connecting to the hand or other body part of a user, one or more swivel joints 18, and a plurality of interchangeable cosmetic containers 16, 16A, 16B, 16C, and so on. Preferably, each cosmetic container is distinguished from the other cosmetic containers through a unique combination of makeup materials, colors and/or accessories such as different foundations, blushes, eye shadows, lipsticks, special effects materials for creating scars, blemishes, etc., pastes, creams, powders, gels, sticks, brushes, pencils, pads, mirrors, and so on. By way of example, one cosmetic container 16 may include three different foundation colors 112, 114, 116 and various brushes 118, while another cosmetic container 16A may include three different blush colors 120, 122, 124 and a mirror 126, a third cosmetic container 16B may include three different eye shadow colors 128, 130, 132 and various eye liner pencils 134, and a fourth cosmetic container 16C may include three different foundation colors 136, 138, 140 that are different from the foundation colors 112, 114, 116, and a blush color 142 that is different from the blush colors 120, 122, 124. It will be understood that the above combinations are given by way of example only and that more or less cosmetic containers may be provided.

Figure 9:
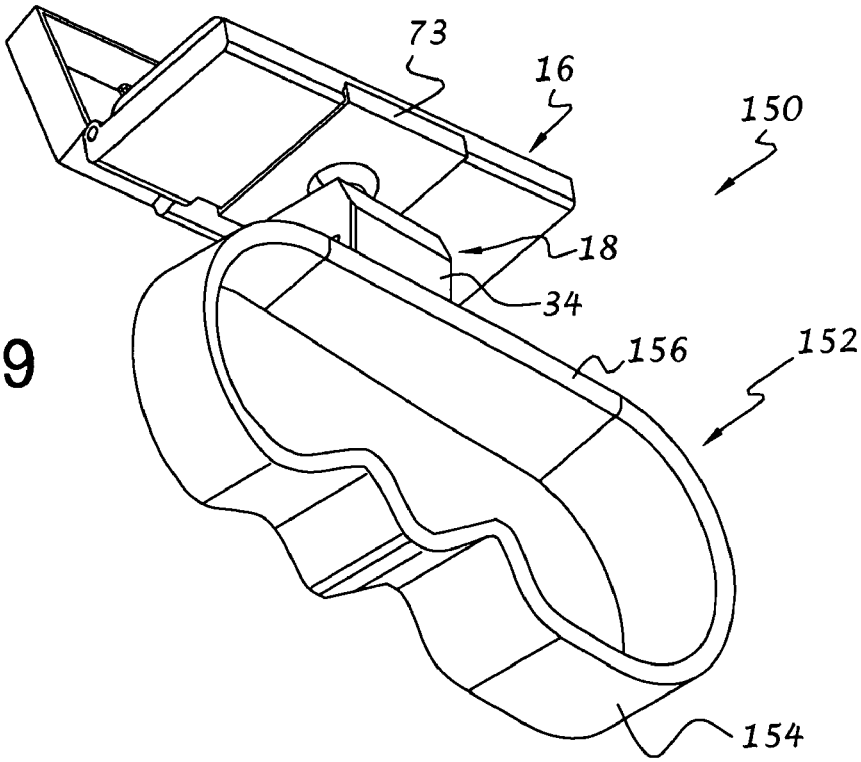
FIG. 9 is a bottom perspective view of a cosmetic holder in accordance with a further embodiment of the invention.

Referring now to FIG. 9, a cosmetic holder 150 In accordance with a further embodiment of the invention is illustrated. The cosmetic holder 150 is similar in construction to the cosmetic holder 10 previously described, with the exception that the mounting base 152 includes a band or strap 154 constructed of a flexible and stretchable material, such as an elastomer, that is connected to a relatively stiff top wall 156. The pivot joint 18 is in turn connected to the top wall 156, preferably in the manner as previously described, for connecting the cosmetic container 16 to the mounting base 152. With this arrangement, the band 154 can be quickly and easily stretched over the hand, wrist or other body part of a user and held in place by friction and the resultant tensile forces of the band 154.

Figure 10:
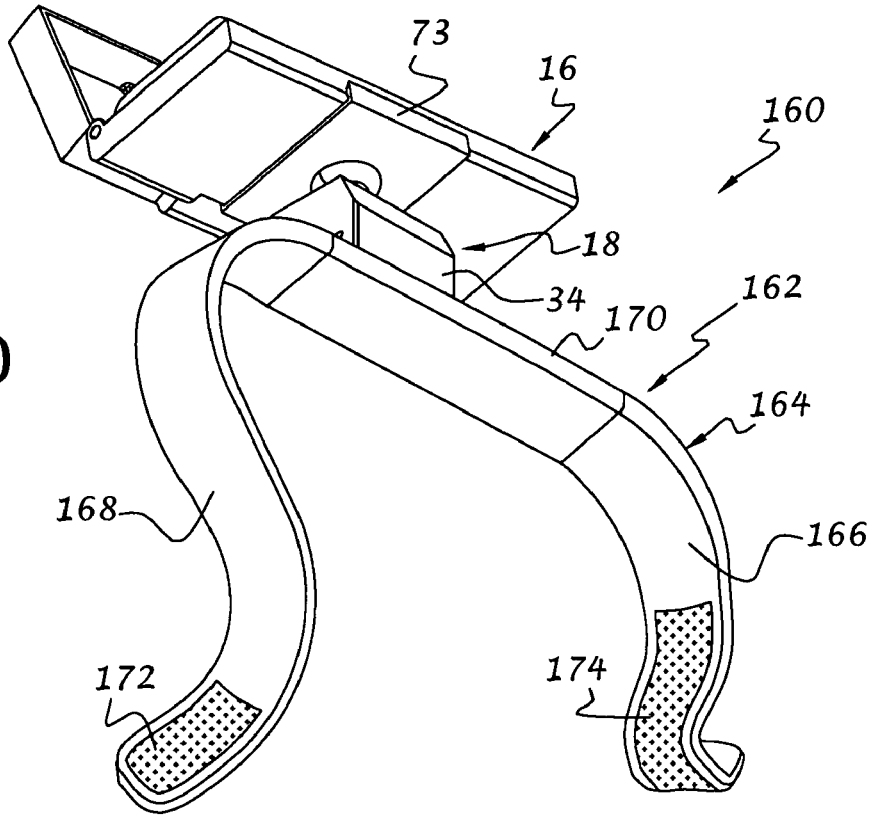
FIG. 10 is a bottom perspective view of a cosmetic holder in accordance with yet another embodiment of the invention.

Referring now to FIG. 10, a cosmetic holder 160 in accordance with another embodiment of the invention is illustrated. The cosmetic holder 160 is similar in construction to the cosmetic holder 10 previously described, with the exception that the mounting base 162 includes a flexible band or strap 164 with a first band portion 166 and a second band portion 168 connected to opposite sides of a relatively stiff top wall 170. One band portion 166 or 168 preferably includes a hook material 172 while the other band portion includes a loop material 174 adapted for engaging the hook material when the band portions are wrapped around the body part of a user for securing the cosmetic holder 160 to the body part. As in the previous embodiment, the pivot joint 18 is connected to the top wall 170 for connecting the cosmetic container 16 to the mounting base 162.

Referring now to FIGS. 11 and 12, a cosmetic holder 180 in accordance with yet a further embodiment of the invention is illustrated. The cosmetic holder 180 preferably includes a band 182 with a relatively stiff upper band portion 184 and relatively flexible lower band portion 186.

The upper band portion 184 has a generally straight section 188 to which a dovetail-shaped projection 30 is attached, a first curved section 190 and a second curved section 192 extending from the straight section in opposite directions. Each curved section 190 and 192 includes an elongate slot 194 and 195, respectively, through which the flexible band portion 186 extends. A strip of flexible foam padding material 196, such as memory foam, is attached to a lower surface 198 of the upper band portion 184 to provide a more comfortable and secure fit for the user.

The lower band portion 186 is preferably constructed of a flexible strip of material and includes a loop section 200 that extends through the slot 195 and a loop section 202 that extends through the slot 194. The loop section 200 is preferably formed by inserting an end 204 of the lower band portion 186 through the slot 195 then securing the end 204 to the lower band portion such as by sewing, adhesive bonding, or any other well-known manner. First and second strips 206, 208 of hook and loop material are located on one surface 210 of the lower band portion 186. In order to adjust and secure the cosmetic holder 180 around the hand, wrist or other body part of a user, the body part is slipped through the opening 212 formed by the upper and lower band portions 184 and 186, respectively. The end 214 of the lower band portion 184 is then pulled until the lower and upper band portions are snug against the body part. The hook and loop strips 206, 208 are then pressed together to secure the lower band portion against movement.

An accessory holder 216 is preferably removably connected to the lower band portion 184 and includes a body 218 with a pair of spaced bores 220, 222 that extend through the body 218 for receiving cosmetic accessories such as brushes. A strip 224 of hook and loop material is located on an opposite surface 228 of the lower band portion 186 and a strip 226 of hook and loop material is located on the body 218 for engaging the strip 224. With this arrangement, the position of the accessory holder 216 can be adjusted along the length of the lower band portion 186 to accommodate different sizes of hands, wrists or other body parts and the particular preferences of the user.

A carabiner clip or snap ring 230 preferably extends through the loop section 200 so that the cosmetic holder can be conveniently carried on the clothing of a user, such as on a belt or belt loop, as well as any other convenient object or location.

Referring now to FIG. 13, an accessory holder 232 in accordance with a further preferred embodiment of the invention is illustrated. The accessory holder 232 preferably includes a pair of elastomeric loops 234, 236 that wrap around the lower band portion 184, preferably close to the end 214. In this manner, accessories, such as brushes 134 (shown in phantom line), can be securely held against the lower band portion and conveniently accessed when needed.

It will be understood that any of the above cosmetic holder embodiments may be used singly or in combination. By way of example, the cosmetic holder 16 may be mounted to the hand of a user while the cosmetic holder 180 may be mounted to the wrist, forearm, or other body part of a user. Likewise, a plurality of the same cosmetic holder 16, 150, 160 or 180 may be mounted to both the hand and wrist and/or other body parts of a user.

It will be understood that the term "preferably" as used throughout the specification refers to one or more exemplary embodiments of the invention and therefore is not to be interpreted in any limiting sense. It will be further understood that the term "connect" and its various derivatives as may be used throughout the specification refer to components that may be removably or permanently attached together either directly or through one or more intermediate members. Moreover, terms of orientation and/or position as may be used throughout the specification relate to relative, rather than absolute, orientations and/or positions.

It will be appreciated by those skilled in the art that changes could be made to the embodiments described above without departing from the broad inventive concept thereof. By way of example, the dovetail mounting arrangement in each of the above-described embodiments may be replaced with any well-known connection means, such as mutually engaging projections, clamps, fasteners, magnets, double adhesive tape, hook and loop fasteners, adhesive bonding, welding, and so on. It will be understood, therefore, that this invention is not limited to the particular embodiments disclosed, but is intended to cover modifications within the spirit and scope of the present invention as defined by the appended claims.

We claim:

1. A cosmetic holder comprising:

a mounting base adapted for mounting to a hand of the user;

at least one first cosmetic container for storing at least one of a cosmetic and a cosmetic accessory;

a swivel joint connected between the mounting base and the cosmetic container for adjusting a position of the cosmetic container with respect to the mounting base;

the mounting base comprises an elongated band formed by linear/elongated upper and lower walls and curved side walls extending between the upper and lower walls, said walls providing a closed loop formation encircling said hand of the user and defining an operational space therebetween, an adjustable clamping member including a shaft portion extending through one of the band side walls, and a yoke portion configured for engagement with a hand of the user, an adjustment knob rotatably connected to one said side wall and in engagement with the shaft portion for moving the shaft portion in a linear direction upon rotation of the adjustment knob to thereby move the yoke portion within the operational space toward and away from said hand of the user;

a dovetail-shaped member extending along the linear/elongated upper wall of the mounting base for receiving at least one mounting block; and said yoke portion during its movement within the operational space engages at least the linear upper and lower walls of the band, so as to enhance stability of usage of the cosmetic holder.

2. A cosmetic holder according to claim 1, wherein the cosmetic container comprises at least one removable compartment.

3. A cosmetic holder according to claim 1, wherein said at least one mounting block includes a dovetail-shaped arrangement for movably engaging the dovetail-shaped member of the mounting base.

4. A cosmetic holder according to claim 1, wherein said band narrows from one said side wall to the other said side wall, so that the said band is received between a thumb and an index finger of said hand of the user.

5. A cosmetic holder according to claim 1, wherein said yoke portion configured for engagement with the hand of the user is substantially symmetrical about said shaft portion, and said yoke portion during its movement within the operational space is symmetrically guided by at least inner surfaces of the linear upper and lower walls of the band.

6. A cosmetic holder according to claim 1, wherein said at least one cosmetic container comprises a plurality of cosmetic containers interchangeably connectable to the mounting base, each cosmetic container having a different combination of cosmetics or cosmetic accessories.

7. A cosmetic holder according to claim 1, wherein the swivel joint further comprises the mounting block including a socket and an opening intersecting the socket;

a ball positioned in the socket; and a pivot rod extending from the ball through the opening, the pivot rod being connectable to the cosmetic container to thereby adjust the cosmetic container about three mutually perpendicular axes during rotation of the ball in the socket.

8. A cosmetic holder according to claim 7, further comprising a mounting plate connected to a distal end of the pivot rod, the cosmetic container being removably connectable to the mounting plate.

9. A cosmetic holder according to claim 1;

wherein the at least one cosmetic container comprises a tray portion and a cover portion pivotally connected to the tray portion.

10. A cosmetic holder according to claim 9, wherein at least one of the tray portion and cover portion includes a plurality of compartments for receiving a plurality of cosmetic materials or accessories.

11. A cosmetic holder according to claim 1, and further comprising a second cosmetic container removably connectable to the swivel joint.

12. A cosmetic holder according to claim 11, wherein the first cosmetic container comprises a first cosmetic and the second cosmetic container comprises a second cosmetic that is different from the first cosmetic.

13. A cosmetic holder according to claim 11, and further comprising a second swivel joint connected to the mounting base for receiving the first or second cosmetic container.

14. A cosmetic kit according to claim 13, wherein the swivel joint is provided for adjusting the cosmetic containers about three mutually perpendicular axes.

* * * * *